US009676465B2

(12) United States Patent
Gai et al.

(10) Patent No.: US 9,676,465 B2
(45) Date of Patent: Jun. 13, 2017

(54) PISTON PUMP

(71) Applicants: Marcella Gai, Genoa (IT); Enrico Pagani, Crocefieschi (IT); Andrea Milanese, Genoa (IT)

(72) Inventors: Marcella Gai, Genoa (IT); Enrico Pagani, Crocefieschi (IT); Andrea Milanese, Genoa (IT)

(73) Assignee: Ultraflex S.p.A., Casella (GE) (IT)

( * ) Notice: Subject to any disclaimer, the term of this patent is extended or adjusted under 35 U.S.C. 154(b) by 297 days.

(21) Appl. No.: 14/485,369

(22) Filed: Sep. 12, 2014

(65) Prior Publication Data

US 2015/0075158 A1 Mar. 19, 2015

(30) Foreign Application Priority Data

Sep. 16, 2013 (IT) ..... GE2013A0088

(51) Int. Cl.

| | |
|---|---|
| ***F04B 1/20*** | (2006.01) |
| ***B63H 25/30*** | (2006.01) |
| ***F04B 9/14*** | (2006.01) |
| ***F01B 3/00*** | (2006.01) |
| ***B63H 25/22*** | (2006.01) |
| ***F04B 1/22*** | (2006.01) |

(52) U.S. Cl.

CPC ..... *B63H 25/30* (2013.01); *B63H 25/22* (2013.01); *F01B 3/0032* (2013.01); *F04B 1/20* (2013.01); *F04B 1/2007* (2013.01); *F04B 1/2042* (2013.01); *F04B 1/22* (2013.01); *F04B 9/14* (2013.01)

(58) Field of Classification Search

CPC ..... B63H 25/30; F01B 3/0032; F04B 1/2007; F04B 1/2042; F04B 9/14

See application file for complete search history.

(56) References Cited

U.S. PATENT DOCUMENTS 3,209,541 A * 10/1965 Dunphy ..... B63H 25/28 60/573

3,566,746 A 3/1971 Harrison

FOREIGN PATENT DOCUMENTS

DE GB 1199600 A * 7/1970 ..... F01B 3/0041

EP 1382845 1/2004

* cited by examiner

*Primary Examiner* — Thomas E Lazo

(74) *Attorney, Agent, or Firm* — Themis Law

(57) ABSTRACT

A hand-operated piston pump includes a drive shaft and a rotor mounted in a housing case, the rotor having axial compression chambers, a piston biased by an elastic member sliding in each compression chamber and having a projecting end that engages a cam track; a fluid reservoir in the housing case; a valve plate downstream of the rotor having conduits for a pressurized fluid that communicate with conduits in walls of the compression chambers, the valve plate being non-rotatably mounted below the housing case and communicating with conduits that carry the pressurized fluid to and from a consuming unit through an interposed check valve inserted in a corresponding valve body, the valve body having an upper flange with fluid supply and return channels communicating with the fluid conduits of the valve plate. The valve plate floats relative to the upper flange and is separated therefrom by a separating member.

13 Claims, 5 Drawing Sheets

PISTON PUMP

FIELD OF THE INVENTION

The present invention relates to a hand-operated piston pump, particularly for directional control of watercraft, boats or the like.

The pump comprises a drive shaft, which is rotatably mounted in a housing case, and a rotor, which is mounted in the housing case and is rotationally integral with the drive shaft, said rotor having a plurality of axial compression chambers formed in the body of the rotor.

The axial compression chambers surround the drive shaft, a piston being axially slidably housed in each compression chamber and biased by elastic means, with one end projecting out of one end side of the corresponding compression chamber against a cam track comprising an annular plate inclined with respect to the axis of rotation of the rotor.

A fluid reservoir is also provided in the housing case.

The pump further comprises a valve plate, which is located downstream from the rotor, in the direction of the fluid, particularly in the flow direction, and has at least two separate conduits for the passage of pressurized fluid, which alternately communicate with conduits for drawing/discharging the pressurized fluid, the latter conduits being provided in the bottom delimiting walls of the compression chambers facing toward the valve plate.

Furthermore, the valve plate is non-rotatably mounted in the housing case to communicate with the conduits for supplying and returning the pressurized fluid to a consuming unit through an interposed check valve inserted in a corresponding valve body.

The valve body has an upper flange, which has fluid supply and return channels communicating with the fluid passage conduits of the valve plate.

BACKGROUND OF THE INVENTION

Hand-operated pumps of this type are known and widely used in hydraulic steering control units, particularly for marine engines, especially outboard engines.

The rotation of the drive shaft in either direction of rotation, e.g. by means of a steering wheel or a helm mounted thereto, generates a displacement of the pressurized fluid in a closed-loop hydraulic circuit in either direction of rotation. The pressurized fluid is supplied from the check valve to each of the two inlets of a double-acting hydraulic cylinder respectively, the latter moving along a shaft which is held stationary between two fixed points connected at its ends, in one direction or in the opposite one, according to the direction of rotation of the drive shaft of the pump. The cylinder is in turn connected by a leverage system to a steering control element, for example of a marine outboard engine or to a rudder control lever.

These prior art devices require high operational accuracy to ensure continuous, smooth operation, with no idle strokes and repeatable steering settings. This reflects on pump construction, which must provide the required pressure differences on both conduits for connection to the double-acting hydraulic cylinder, in spite of a very low rpm, because the shaft is manually operated and the rotation speed and the stroke of the steering wheel has to ensure maximized comfort and reliability.

Therefore, those pumps are relatively complex and expensive, as they are composed of relatively complex parts, having complex conduits for the passage of the pressurized fluid.

In prior art pumps, the valve plate is generally made of one piece with a closing base of the housing case, which consists of an overturned cup-shaped element having a central through hole for the end of the drive shaft to project therethrough and to be rotatably coupled to the steering wheel or the helm. The check valve is in turn sealingly secured to that base. The manufacture of the valve plate, with the holes and ports for the passage of pressurized fluids, in a single construction piece, i.e. in one piece with the base, is generally relatively expensive both in terms of fabrication of the blank and for the required drilling of the passages for the pressurized fluid, as well as for additional finishing steps.

A valve plate integrated with the base has a very high cost. Also, it requires use of a material and a surface treatment that will both ensure hardness and durability and equally conform to the stainless requirements of the base.

The valve plate generally has two eccentric axial holes, which open on the side of the valve plate associated to the rotor, into diametrically opposed radial recesses of the valve plate, which extend to almost half of the section of the valve plate and are separated by a thin intermediate diametric partition.

Those holes and these recesses are also not easily formed, when the base is made of one piece with the valve plate. Furthermore, the base must be also formed with various shapes and apertures for the passage of both the pressurized fluid and the screws that fasten it to the cup-shaped part, as well as for additional seats or receptacles, e.g. for the bearings that support the corresponding end of the rotor.

As mentioned above, prior art piston pumps must be particularly efficient and provide immediate responses even to the slightest rotation angles of the control member.

Due to these requirements, a high degree of accuracy is required for construction and assembly of the above mentioned parts, which will strongly impinge on manufacturing and maintenance costs for the pumps.

Therefore, there exists a yet unfulfilled need in the art for a piston pump that can resolve the above described drawbacks of prior art pumps, particularly a piston pump that can provide the same efficiency as prior art pumps while affording low manufacturing costs and easy construction.

SUMMARY OF THE INVENTION

The present invention fulfills the above objects by providing a piston pump as described hereinbefore, in which the valve plate is mounted to float relative to the upper flange, O-ring seals or the like being interposed between the valve plate and the upper flange, such that the valve plate is separate from the upper flange.

Therefore, a pump according to the present invention uses a floating part, particularly the valve plate.

In this case, lower construction accuracy requirements are required for the valve plate, in comparison with prior art pumps, and costs are accordingly reduced.

Since the valve plate is supported through two elastic seals, any overpressure occurring in the pump body may be more effectively compensated for.

This is because excess fluid pressure causes the valve plate to press against the elastic seals and prevent any fluid leakage or spillage.

The elastic behavior of the seals allows recovery of all construction tolerances.

In a first embodiment, a locking ring is provided, which is fixed to the upper flange, the valve plate being interposed between the locking ring and the upper flange, such that the locking ring presses against the seals.

The valve plate is mounted to be in contact with the locking ring and separate from the upper flange.

Therefore, the locking ring holds the valve plate prestressed against the seals to a well-defined extent, while providing for a residual elastic deformability of the seals, such that the valve plate can float relative to the upper flange.

This will ensure a hydraulic sealing effect even under no load. For example, during filling and purging of the pump, a zero or quasi-zero pressure is generated, and this arrangement prevents the ingress of air from the outside.

The locking ring may be fixed to the upper flange in any manner known in the art, for instance with screws arranged in different patterns, according to construction requirements.

In order to optimize the thrust applied by the seals on the valve plate and the sealing action of the valve plate, and avoid spillage, the seals preferably consist of o-rings or the like, having a lobe-shape.

In this embodiment, the seals are accommodated in corresponding lobe-shaped seats formed in the thickness of the valve plate and/or the thickness of the upper flange.

Since the locking ring presses against the seals, this arrangement prevents the seals from accidentally coming off their seats.

Advantageously, two seals are provided within two corresponding seats.

The seats communicate with the fluid passage conduits in said valve plate and with the fluid supply and return channels in the upper flange.

As more clearly shown in the exemplary embodiments that will be described below, if fluid also passes through the lobe-shaped seats, further compensation for overpressure is provided.

In a preferred variant, the drive shaft is disengaged from the rotor.

An engagement member is provided on the drive shaft, and engages with a corresponding engagement seat on the rotor.

Thus, the drive shaft and/or the rotor are free to translate along their own longitudinal axis.

The engagement member consists of an element that radially extends from the lateral surface of the drive shaft, and the engagement seat consists of a recess formed in the thickness of the lateral wall of the rotor.

An elastic member is preferably provided in the form of a helical spring or the like, coaxial with the drive shaft and interposed between the rotor and the housing case.

This arrangement will provide a pump that has more than one floating part, and the movement and settlement of the different parts will compensate for any clearance and inaccuracy resulting from the manufacture of each part.

The provision of the engagement member allows the drive shaft to be disengaged from the rotor, and causes the shaft to drive the rotor into rotation, with the engagement member in the engaged state.

Furthermore, when the pump is assembled, the helical spring is compressed to a given extent; such spring pushes the shaft against the reservoir and, at the same time, the rotor against the valve plate, thereby promoting a hydraulic sealing effect both during normal operation and during filling and purging of the pump. Without a perfect sealing effect, the rotor will tend to tilt and suck in air and the pump then cannot be primed.

Furthermore, the helical spring prevents the plate from rising up and air from flowing between the rotor and the plate.

In one embodiment, at least one relief valve is provided, which is inserted in a seat formed in the thickness of the valve body.

This relief valve allows the passage of fluid to the reservoir as a given threshold pressure is reached in the delivery and/or suction ports of the pump.

Preferably, the seat is a body with cylindrical symmetry, in the form of a can, which is inserted in the thickness of the wall of the valve body.

This feature is particularly advantageous because the can is easily mounted and may be easily replaced in case of malfunctioning without damaging the entire pump.

In one embodiment, the drive shaft has a longitudinal channel extending over at least part of its length, which is connected to a radial channel that communicates with the reservoir.

The oil flow allowed by the channel formed in the drive shaft is used to relieve overpressure or remove excess oil if the pump is used with unbalanced cylinders.

The channel may be formed anywhere in the drive shaft, e.g. on the outer surface thereof, but preferably the longitudinal channel consists of a longitudinal hole formed at the center axis of the shaft.

Furthermore, the longitudinal hole is threaded at least over a part of its length, at the end of the drive shaft facing toward the valve plate.

This improvement facilitates mounting and assembly of the various parts of the pump.

Particularly, the above described characteristics will obviously impart modular features to the pump of the invention, allowing easy mounting and assembly of the various parts.

Also, the concept that adds novelty and inventive step to the pump of the present invention, and makes it particularly advantageous as compared with prior art pumps due to the provision of floating or semi-floating parts which might compensate for a low degree of accuracy in the construction of each part, thereby affording considerable savings.

Thus, the present invention also relates to a pump, in which the drive shaft is disengaged from the rotor, an engagement member being provided on the drive shaft, said engagement member engaging with a corresponding engagement seat on the rotor.

The engagement member consists of an element that radially extends from the lateral surface of the drive shaft, and the engagement seat consists of a recess formed in the thickness of the lateral wall of the rotor, such that the drive shaft and/or the rotor are free to translate along their own longitudinal axis.

A helical spring is also provided coaxial with the drive shaft and interposed between the rotor and the housing case.

With this arrangement, both the drive shaft and the rotor are floating parts.

The above described pump may be provided in combination with one or more of the above described features.

The present invention further relates to a steering device for vehicles, particularly boats or the like, which includes a manual control member, such as a steering wheel or the like, that is connected to a drive shaft of a pressurized fluid supply and distribution unit for manually driving the latter during rotation of the drive shaft.

The supply and distribution unit includes a piston pump, which is connected by its delivery and suction ports respectively and alternately to the two chambers of at least one steering actuator, such as a double-acting hydraulic cylinder or the like, through hydraulic conduits for alternately supplying fluid to either one of the two chambers of the actuator, according to the direction of movement, particularly rotation, of the control member.

The piston pump is constructed according to one or more of the previously described characteristics, which may be provided individually or in combination.

BRIEF DESCRIPTION OF THE DRAWINGS

These and other features and advantages of the present invention will appear more clearly from the following description of a few embodiments, illustrated in the enclosed drawings, in which.

Figure 1A:
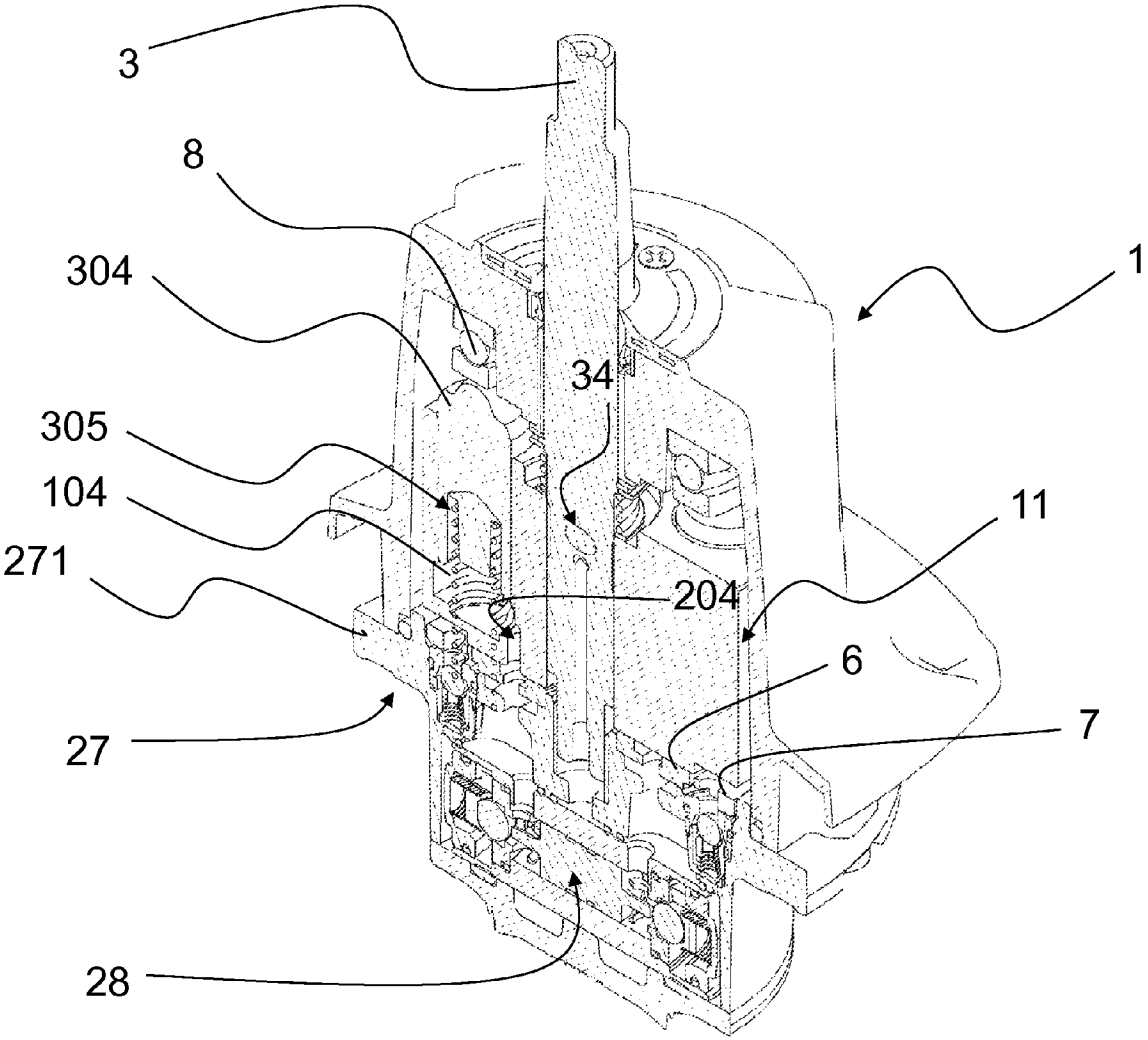
FIGS. 1*a*-1*d* show four sections of a pump according to the present invention as viewed along four different sectional planes.

It should be noted that, while the figures enclosed herein illustrate a preferred embodiment of a pump according to the present invention, those figures shall be only intended as an exemplary illustration for a better understanding of the concepts and advantages of the present invention.

Thus, those figures shall not be intended to limit the scope and breadth of the present invention, in particular, the provision of a pump having floating parts.

DETAILED DESCRIPTION OF EMBODIMENTS OF THE INVENTION

FIGS. 1*a*-1*d* show a hand-operated piston pump according to the present invention, which is particularly suited for directional control of a watercraft, a boat or the like.

The illustrated pump comprises a drive shaft 3, which is rotatably mounted in a housing case 1, a rotor 4 being mounted in the housing case 1.

The rotor 4 is rotationally integral with the drive shaft 3 and has a plurality of axial compression chambers 104 formed in the body of the rotor 4, which surround the drive shaft 3.

A piston 304 is axially and slidably housed in each compression chamber 104 and is biased by elastic means 305, with one end projecting out of one end side of the corresponding compression chamber 104 against a cam track 8 consisting of an annular plate inclined with respect to the axis of rotation of the rotor 4.

The pump further comprises a fluid reservoir 11 in the housing case 1, as well as a valve plate 6 located downstream from the rotor 4.

Figure 2B:
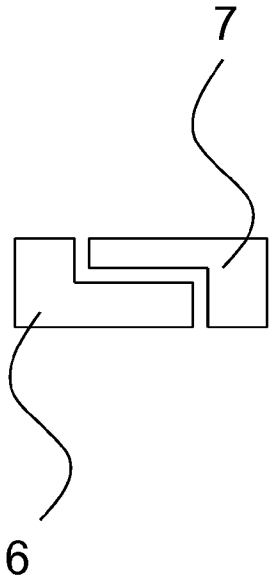
FIGS. 2*a* and 2*b* show two different views of the valve plate in a piston pump according to the present invention.
Figure 2A:
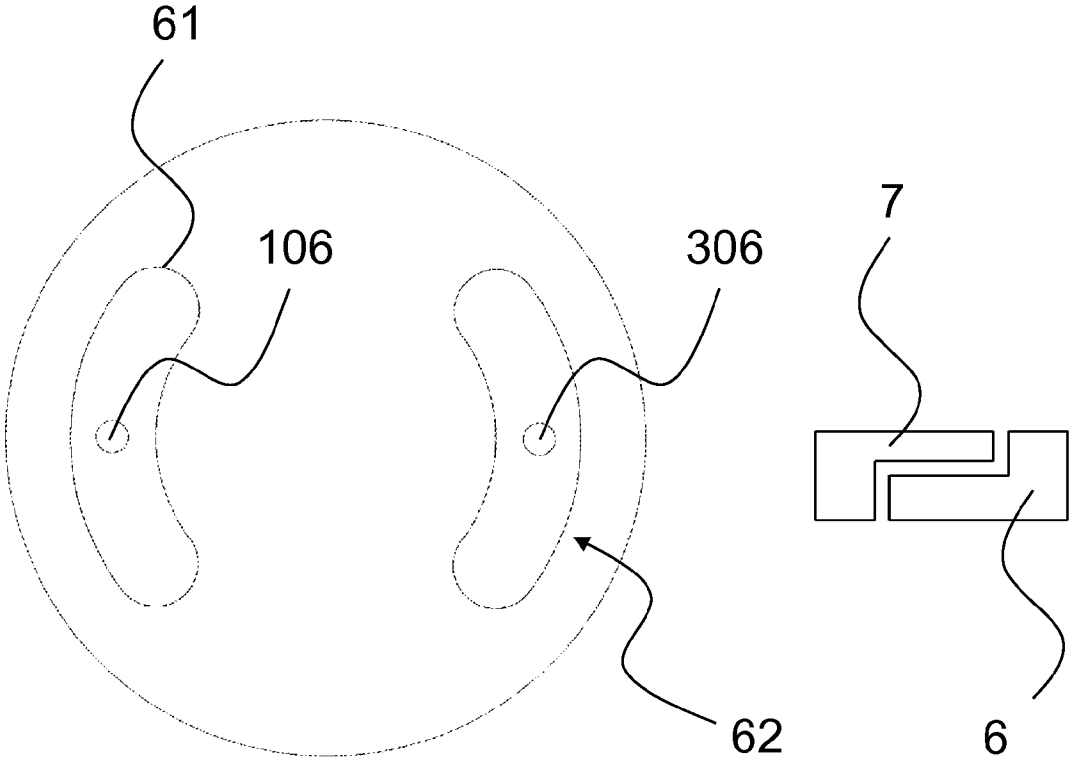

The valve plate 6 has at least two separate conduits 106, 306, see FIGS. 2*a* and 2*b*, for the passage of pressurized fluid, which alternately communicate with conduits 204 for drawing/discharging the pressurized fluid, the latter conduits being provided in the bottom delimiting walls of the compression chambers 104 facing toward the valve plate 6.

Furthermore, the valve plate 6 is non-rotatably mounted below the housing case 1 and communicates with the conduits for supplying and returning the pressurized fluid to a consuming unit through an interposed check valve 28 inserted in a corresponding valve body 27, the latter having an upper flange 271, with fluid supply and return channels communicating with the fluid passage conduits 106, 306 of the valve plate 6.

It shall be noted that while the check valve may be fabricated as is known in the art, in the present embodiment it is fabricated according to the characteristics described in EP 1382845.

The use of the check valve prevents fluid from being supplied and discharged to the chambers of the steering actuator when the control member is still, and also affords a more efficient adjustment of supply thereto during steering.

Particularly, the valve plate 6 is mounted to float relative to the upper flange 271.

O-ring seals or the like 61 are interposed between the valve plate 6 and the upper flange 271 such that the valve plate 6 is separate from the upper flange 271.

Therefore, the valve plate 6 is an independent part, which is non-rotatably mounted below the housing case 1 and above the upper flange 271.

Preferably, the upper flange 271 has at least two engagement teeth, not shown, which cooperate with corresponding engagement seats on the valve plate 6 to prevent any rotation of the plate.

Particularly referring to FIG. 1*a*, O-ring seals 121 may be also provided at the interface between the housing case 1 and the upper flange 271.

Also preferably, the valve body 27 and the upper flange 271 are made of one piece.

According to the variant embodiment of the figures, a locking ring 7 is provided, which is fixed to the upper flange 271.

The valve plate 6 is interposed between the locking ring 7 and the upper flange 271, such that the locking ring 7 may press against the seals 61 and the valve plate 6 is mounted in contact with the locking ring 7 and separate from the upper flange 271.

FIG. 2*b* shows a section of the valve plate 6 and the locking ring 7 assembled together, as taken along a longitudinal plane.

In the variant of FIG. 2*b*, the section of the valve plate 6 has a L-shaped profile, whereas the locking ring 7 has a section with an inverted L-shaped profile.

This configuration optimizes the sealing action of the locking ring 7 toward the valve plate 6 while limiting the thickness of the pump and optimizing its size.

As shown in FIG. 2*a*, the seals 61 are O-rings, said O-rings having a lobe shape.

Particularly, the seals are accommodated in corresponding lobe-shaped seats 62.

Particularly referring to FIG. 2*a*, the seats 62 may be formed in the thickness of the valve plate 6.

In one embodiment, these seats 62 may be formed in the thickness of the upper flange 271.

Preferably, according to the illustrated variant embodiment, two seals 61 are provided within two corresponding seats 62, which communicate with the fluid passage conduits 106, 306 formed in the valve plate 6 and with the fluid supply and return channels formed in the upper flange 271.

Particularly, the fluid passage conduits 106, 306 are placed at the center of each seat 62 and form a "tank" element which is filled with the fluid during operation of the pump.

Figure 1B:
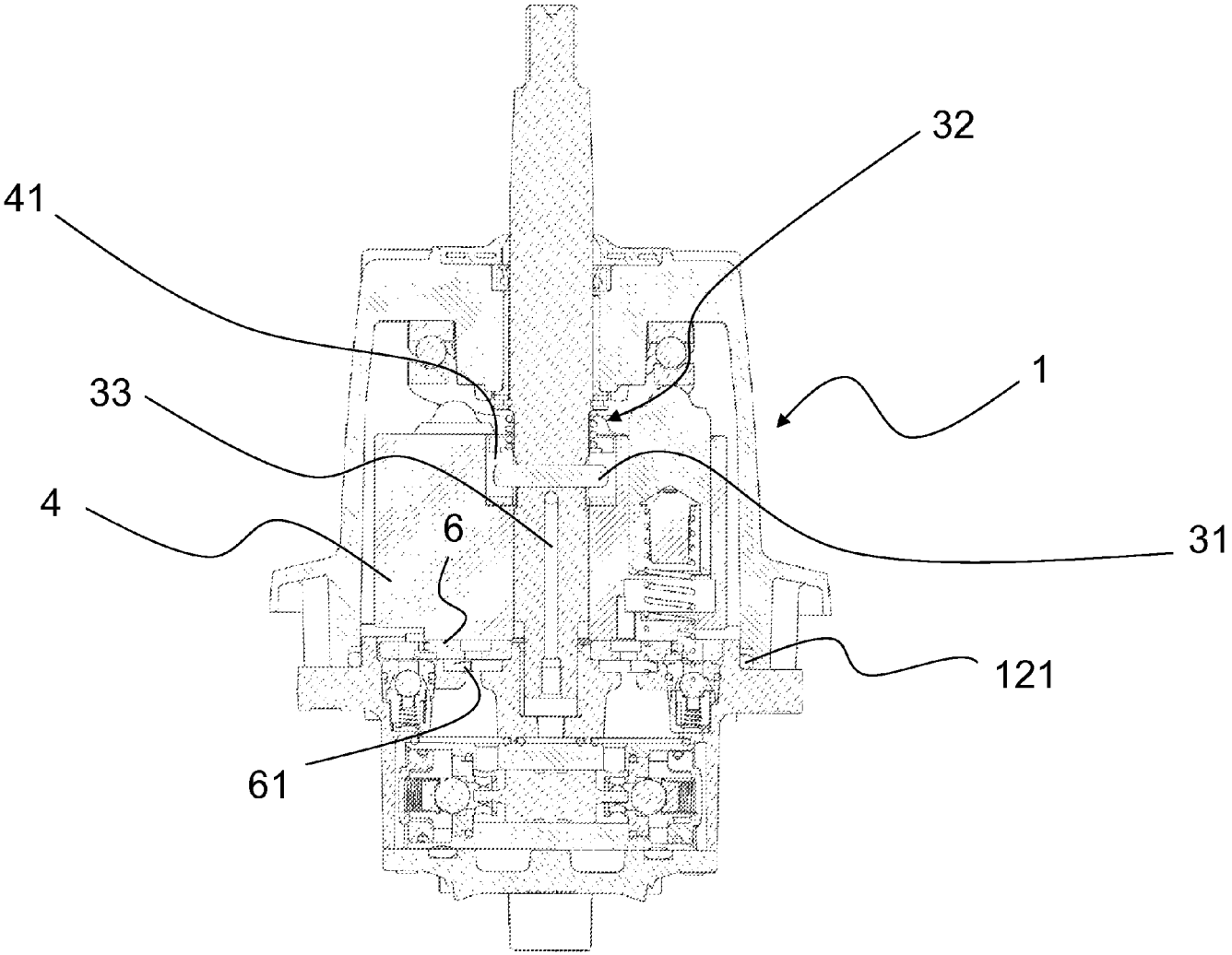
Figure 1C:
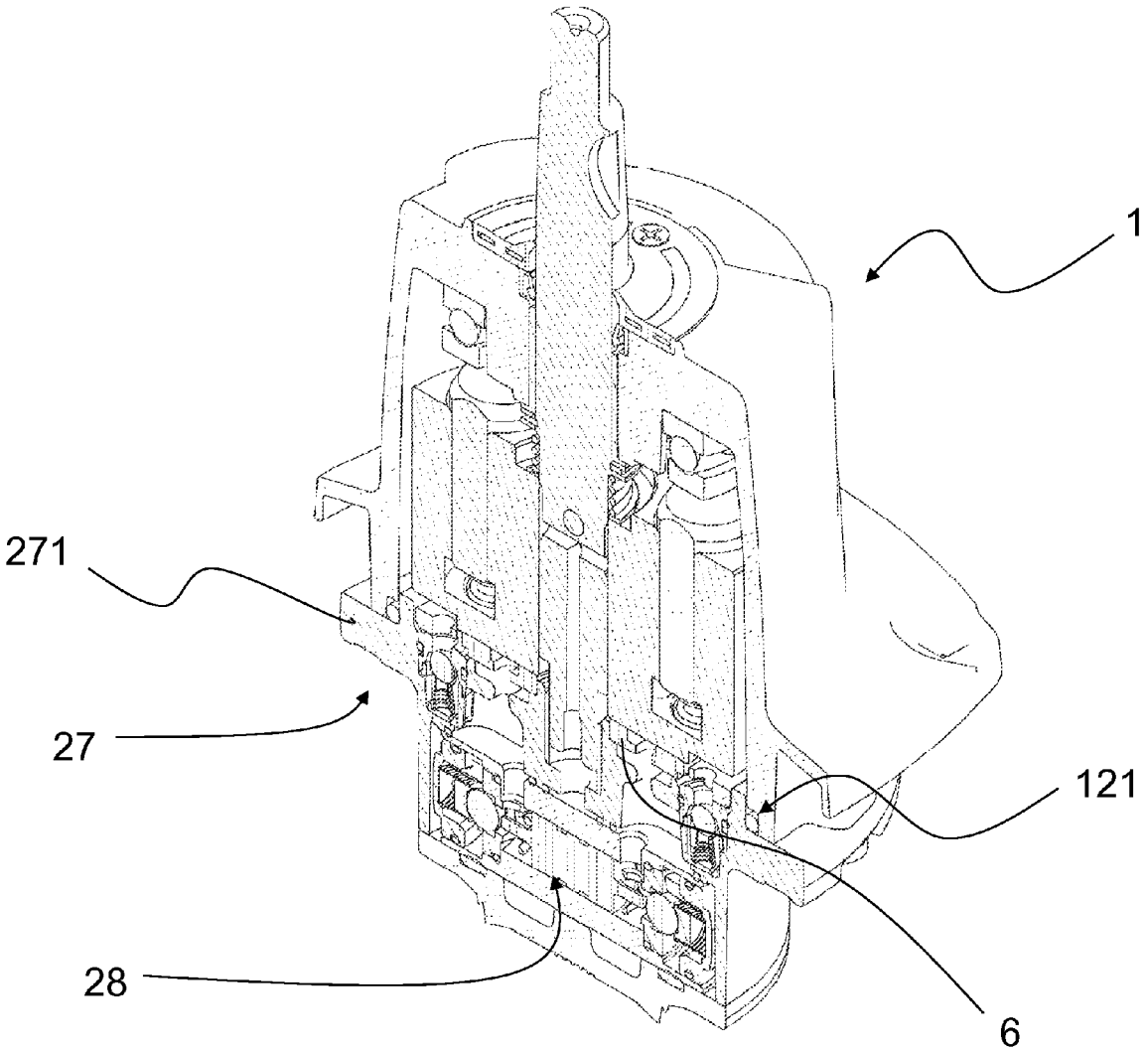

Referring to FIG. 1*b*, the drive shaft 3 is disengaged from the rotor 4, an engagement member 31 being provided on the drive shaft 3 and engaging with a corresponding engagement seat 41 on the rotor 4.

The engagement member 31 preferably consists of an element that radially extends from the lateral surface of the drive shaft 3, the engagement seat 41 consisting of a recess formed in the thickness of the lateral wall of the rotor 4, such that the drive shaft 3 and/or the rotor 4 are free to translate along their own longitudinal axis.

Preferably, the engagement member 31 is not formed of one piece with the drive shaft 3 but consists of a pin 31 which is housed in a receptacle formed in the drive shaft 31, engaging with the engagement seat 41.

In order to allow longitudinal translation of the drive shaft 3 and the rotor 4, the pin 31 is "suspended", i.e. does not rest on the bottom of the engagement seat 41 formed in the rotor 4.

Elastic elements may be provided in the engagement seat 41, for damping the movement of the pin, such that the pin is not allowed to contact the bottom of the engagement seat 41.

A helical spring 32 is also provided coaxial with the drive shaft 3 and interposed between the rotor 4 and the housing case 1.

The helical spring 32 allows adjustment of the relative movement of the drive shaft 3-rotor 4 assembly, especially during mounting of the individual parts, as well as during oil purging.

During pump assembly, the helical spring 32 may become compressed to a given extent.

In this configuration, when the housing case 1 is mounted, the pin 31 moves downwards, and remains suspended at about the middle the engagement seat 41.

Depending on the pre-loading of the helical spring 32, this spring 32 pushes the drive shaft 3 upward and the rotor 4 downward, while still maintaining the sealing effect, because the housing case 1 stops the movement of the drive shaft 3 upward.

For the force of the helical spring 32 to be properly discharged between the housing case 1 and the rotor 4, the engagement seat 41 for the pin 31 has a depth that is much greater than its diameter and/or its section.

Figure 1D:
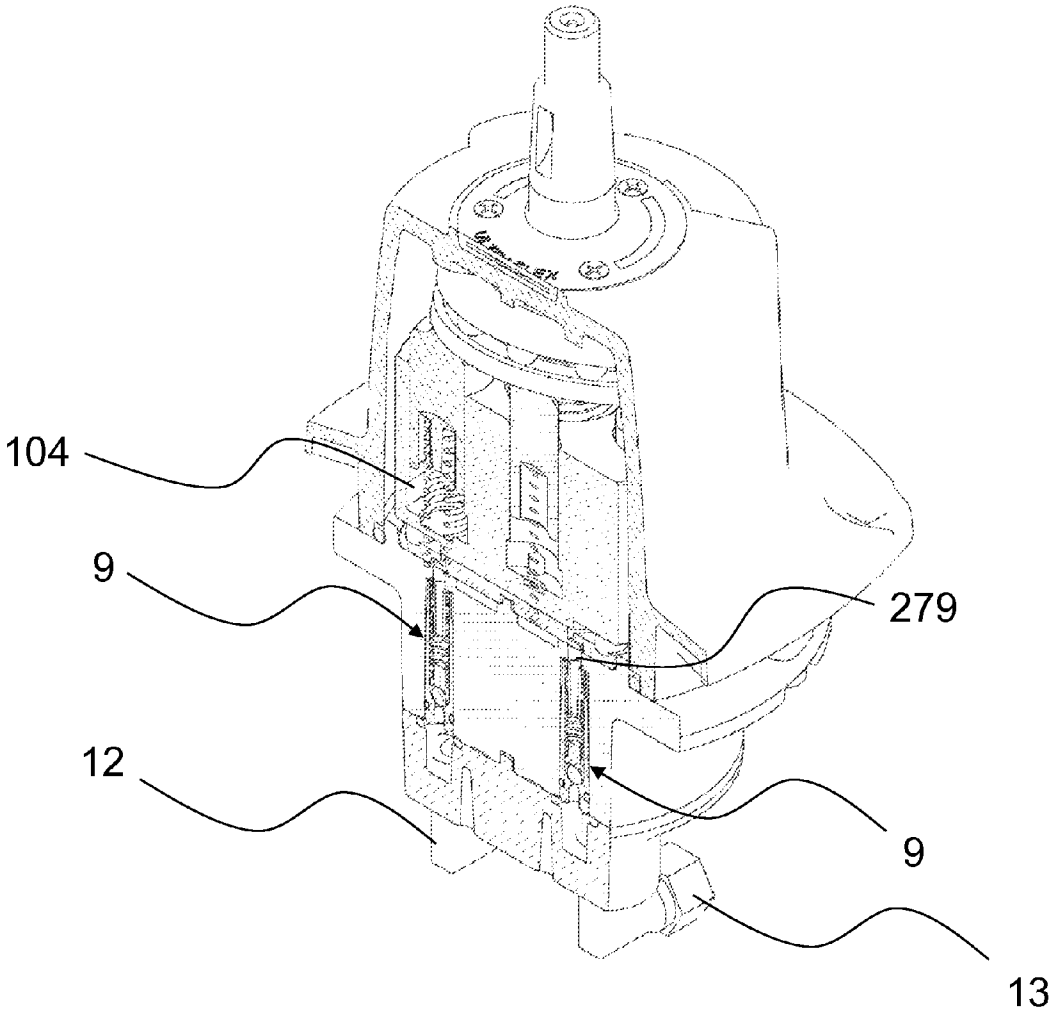

FIG. 1*d* depicts a section of a pump according to the present invention in one embodiment, in which at least one, preferably two relief valves 9 are inserted in a seat formed in the thickness of the valve body 27.

The relief valves allow the passage of fluid to the reservoir 11 when a given threshold pressure is reached in the delivery 12 and/or suction 13 ports of the pump.

Particularly referring to FIGS. 1*a*-1*d*, the fluid passes from the drawing/discharging conduits 204 in the bottom delimiting walls of the compression chambers 104 to the delivery 12 and/or suction 14 ports through the fluid passage conduits 106, 306 of the valve plate 6 and through the check valve 28.

Particularly, the conduits 106, 306 communicate with the check valve 28 through two holes 279 in the upper flange 271.

If high pressure is reached in the delivery 12 and/or suction 13 ports, the relief valves 90 allow venting of the fluid into the reservoir 11.

As shown in FIG. 1*d*, the relief valves may be located in bodies with cylindrical symmetry, such as cans, inserted in the thickness of the wall of the valve body 27.

These cans allow the provision of "self-standing" relief valves, which may be inserted from the back of the pump, i.e. the bottom, irrespective of the construction of the valve body 27.

Like the relief valves, the intake valves may be also inserted in a seat formed in the thickness of the valve body 27.

The intake valves may be located in bodies with cylindrical symmetry, such as cans, inserted in the thickness of the wall of the valve body 27.

Several vents may be provided in the various parts, for venting excess fluid, according to navigation conditions. As the drive shaft 3 is rotated, the piston 7 may push on an area filled with fluid, and that fluid should be vented to restore a normal drive feel.

Therefore, apertures may be preferably provided, for example on the valve plate 6, for the passage of excess fluid.

The drive shaft 3 may also have fluid venting channels, for re-introducing excess fluid into the reservoir 11.

These channels may be formed externally, i.e. on the outer surface of the drive shaft 3 or, like in the embodiment shown in FIG. 1*a*, the drive shaft 3 may have a longitudinal hole 33 formed therein over at least part of its length and connected to a radial hole 34 in communication with the reservoir 11.

Preferably, the longitudinal hole 33 is threaded at least over a part of its length, at the end of the drive shaft 3 facing toward the valve plate 6.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become obvious to those skilled in the art and the scope of the present invention is limited only by the appended claims.

The invention claimed is:

1. A hand-operated piston pump, particularly for directional control of watercrafts, or boats, said pump comprising:

a drive shaft (3), which is rotatably mounted in a housing case (1);

a rotor (4), which is mounted in the housing case (1) and is rotationally integral with the drive shaft (3), said rotor (4) having a plurality of axial compression chambers (104) formed in a body of said rotor (4), said axial compression chambers (104) surrounding the drive shaft (3);

a piston (304) axially and slidably housed in each compression chamber (104) and biased by an elastic member, the piston having one end projecting out of one end side of a corresponding compression chamber (104) against a cam track (8) comprising an annular plate inclined with respect to an axis of rotation of the rotor (4);

a fluid reservoir in said housing case (1); and a valve plate (6) located downstream from the rotor (4) and having at least two separate fluid passage conduits (106, 306) for passage of a pressurized fluid, the at least two separate conduits (106, 306) alternately communicating with conduits (204) for drawing or discharging the pressurized fluid, the latter conduits being provided in bottom delimiting walls of the compression chambers (104) facing toward the valve plate (6), wherein the valve plate (6) is non-rotatably mounted below the housing case (1) and communicates with conduits for supplying and returning the pressurized fluid to a consuming unit through an interposed check valve (28) inserted in a corresponding valve body (27), said valve body (27) having an upper flange (271), said upper flange having fluid supply and return channels communicating with said fluid passage conduits (106, 306) of said valve plate, and wherein said valve plate (6) is disposed to float relative to said upper flange (271), sealing members being interposed between said valve plate (6) and said upper flange (271) to cause said valve plate (6) to be separate from said upper flange (271).

2. The hand-operated piston pump as claimed in claim 1, further comprising a locking ring, which is fixed to said upper flange (271), said valve plate (6) being interposed between said locking ring and said upper flange (271), such that said locking ring presses said sealing members, wherein said valve plate is mounted to be in contact with said locking ring and separate from said upper flange (271).

3. The hand-operated piston pump as claimed in claim 1, wherein said sealing members are O-rings having a lobe shape, and wherein said sealing members are disposed in corresponding lobe-shaped seats formed in one or both of a thickness of said valve plate (6) or a thickness of said upper flange (271).

4. The hand-operated piston pump as claimed in claim 3, wherein two seals are provided within two corresponding seats, said seats communicating with said fluid passage conduits (106, 306) in said valve plate (6) and with said fluid supply and return channels in said upper flange (271).

5. The hand-operated piston pump as claimed in claim 1, wherein said drive shaft (3) is disengaged from said rotor (4), an engagement member being provided on said drive shaft (3), said engagement member engaging a corresponding engagement seat on said rotor (4), said engagement member (31) having an element that radially extends from a lateral surface of said drive shaft (3), said engagement seat (41) being shaped as a recess formed in a thickness of a lateral wall of said rotor (4), such that one or both of said drive shaft (3) or said rotor (4) are free to translate along their longitudinal axes, and wherein an elastic member is provided that is shaped as a helical spring disposed coaxially with said drive shaft (3) and interposed between said rotor (4) and said housing case (1).

6. The hand-operated piston pump as claimed in claim 1, wherein at least one relief valve is provided, said relief valve being inserted in a seat formed in a thickness of said valve body (27), and wherein said relief valve is configured to allow fluid passage to the reservoir when a given threshold pressure is reached in delivery or suction ports of said pump.

7. The hand-operated piston pump as claimed in claim 1, wherein the drive shaft (3) has a longitudinal channel extending over at least part of a length of the drive shaft, the longitudinal channel being connected to a radial cannel that communicates with the reservoir.

8. The hand-operated piston pump as claimed in claim 7, wherein said longitudinal channel is defined by a longitudinal hole formed at a center axis of said shaft, said longitudinal hole being threaded at least over a part of its length, at an end of said drive shaft (3) toward said valve plate (6).

9. A steering device for vehicles, particularly boats or the like, comprising:

a manual control member (11) connected to a drive shaft (3) of a pressurized fluid supply and distribution unit and configured to manually drive the pressurized fluid supply and distribution unit during rotation of the drive shaft (3), the supply and distribution unit comprising a piston pump, wherein said piston pump is connected by delivery and suction ports respectively and alternately to two chambers of at least one steering actuator through hydraulic conduits for alternately supplying fluid to either one of the two chambers of the at least one steering actuator, according to a direction of movement of the manual control member, and wherein said piston pump is according to claim 1.

10. The steering device as claimed in claim 9, wherein the steering actuator is a double-acting hydraulic cylinder.

11. The steering device as claimed in claim 9, wherein said piston pump further comprises a locking ring, which is fixed to said upper flange (271), said valve plate (6) being interposed between said locking ring and said upper flange (271), such that said locking ring presses said seals, and wherein said valve plate is mounted to be in contact with said locking ring and separate from said upper flange (271).

12. A hand-operated piston pump, particularly for directional control of watercrafts or boats, said pump comprising:

a drive shaft (3), which is rotatably mounted in a housing case (1);

a rotor (4), which is mounted in the housing case (1) and is rotationally integral with the drive shaft (3), said rotor (4) having a plurality of axial compression chambers (104) formed in a body of said rotor (4), said axial compression chambers (104) surrounding the drive shaft (3);

a piston (304) axially and slidably housed in each compression chamber (104) and biased by an elastic member, the piston having one end projecting out of one end side of a corresponding compression chamber (104) against a cam track (8) consisting of an annular plate inclined with respect to an axis of rotation of the rotor (4);

a fluid reservoir in said housing case (1);

a valve plate (6) located downstream from said rotor (4) and having at least two separate fluid passage conduits (106, 306) for passage of pressurized fluid, the at least two separate conduits (106, 306) alternately communicating with conduits (204) for drawing or discharging said pressurized fluid, the latter conduits being provided in bottom delimiting walls of said compression chambers (104) facing toward said valve plate (6), wherein said valve plate (6) is non-rotatably mounted below said housing case (1), and said valve plate (6) communicating with conduits for supplying and returning the pressurized fluid to a consuming unit through an interposed check valve (28) inserted in a corresponding valve body (27), said valve body (27) having an upper flange (271), said upper flange having fluid supply and return channels communicating with said fluid passage conduits (106, 306) of said valve plate, wherein said drive shaft (3) is disengaged from said rotor (4), wherein an engagement member is provided on said drive shaft (3), said engagement member engaging with a corresponding engagement seat on said rotor (4), and wherein said engagement member comprises an element that radially extends from a lateral surface of said drive shaft (3) and said engagement seat is defined by a recess formed in a thickness of a lateral wall of said rotor (4), such that one or both of said drive shaft (3) or said rotor (4) are free to translate along their own longitudinal axes; and a helical spring coaxial with said drive shaft (3) and interposed between said rotor (4) and said housing case (1), wherein said valve plate (6) is disposed to float relative to said upper flange (271), sealing members being interposed between said valve plate (6) and said upper flange (271) to cause said valve plate (6) to be separate from said upper flange (271).

13. The hand-operated piston pump as claimed in claim 12, further comprising a locking ring, which is fixed to said upper flange (271), said valve plate (6) being interposed between said locking ring and said upper flange (271), such that said locking ring presses said sealing members, wherein said valve plate is mounted to be in contact with said locking ring and separate from said upper flange (271).

* * * * *